US005600909A

United States Patent [19]

Hooper

[11] Patent Number: 5,600,909

[45] Date of Patent: Feb. 11, 1997

[54] ILLUMINATED CHANGEABLE MESSAGE DISPLAY

[76] Inventor: Steve A. Hooper, 1837 Cord, Odessa, Tex. 79762

[21] Appl. No.: 445,417

[22] Filed: May 19, 1995

[51] Int. Cl.[6] ..... G09F 13/00

[52] U.S. Cl. ..... 40/558; 40/564; 362/225; 362/255; 362/812; D26/75; D20/10

[58] Field of Search ..... 40/564, 541, 558, 40/542; 362/217, 225, 255, 256, 223; D20/812, 10; D26/75, 76, 77, 78

[56] References Cited

U.S. PATENT DOCUMENTS

| | | | |
|---|---|---|---|
| 2,720,056 | 10/1955 | Levy | 362/253 X |
| 3,054,205 | 9/1962 | Sierpin | 40/558 |
| 4,864,475 | 9/1989 | Jung | 40/581 X |

*Primary Examiner*—Kenneth J. Dorner
*Assistant Examiner*—Cassandra Davis
*Attorney, Agent, or Firm*—Milburn & Peterson, P.C.

[57] ABSTRACT

An illuminated changeable message display system utilizing a plurality of fluorescent lamps in an array of multi colored light or aesthetic design patterns of light which extend exterior of a message display box supported in a suitable framework that may be mounted upon a suitable masonry base or suspended from a suitable support or may be free standing. The illuminated message display system may have single or double sided message boxes and may be upright or horizontal with suitable mounting. These message display systems may include a frame work having a mirror and diffusion panel to enhance the color arrays of the fluorescent lamps exposed outside of the message box. An electrical system is provided contained within the frame work to energize the fluorescent lamps.

15 Claims, 3 Drawing Sheets

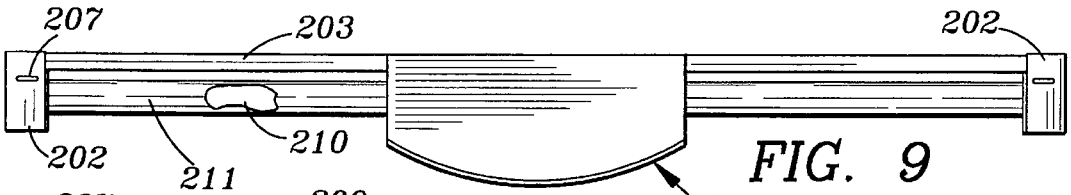
FIG. 9
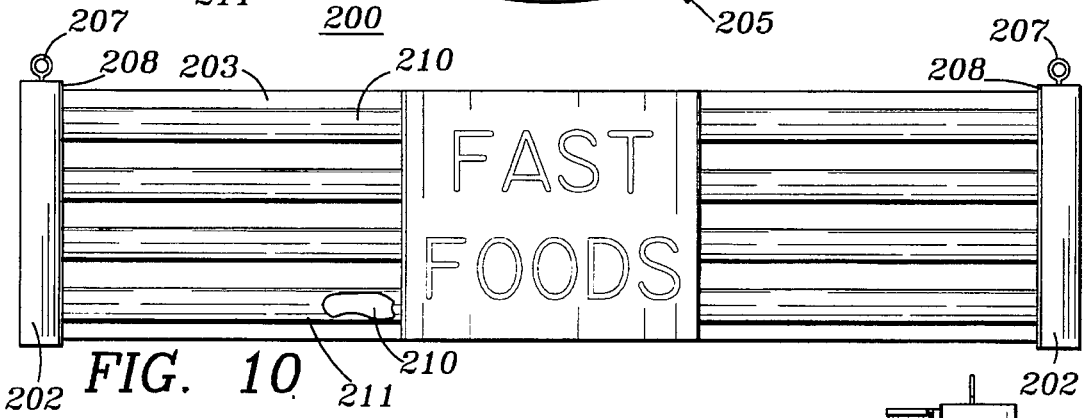
FIG. 10
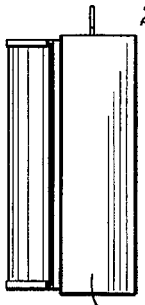
FIG. 11
FIG. 12
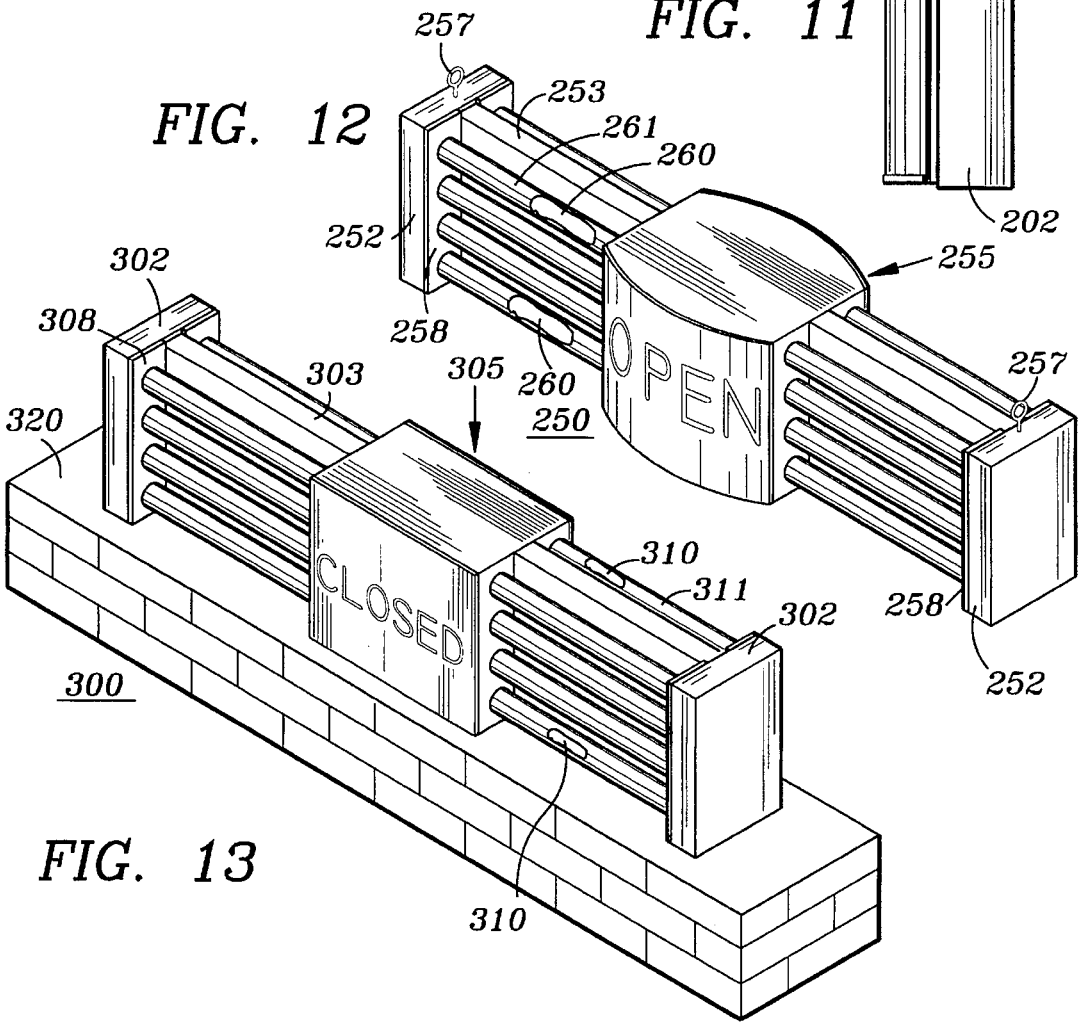
FIG. 13

ILLUMINATED CHANGEABLE MESSAGE DISPLAY

BACKGROUND OF THE INVENTION

This invention relates to illuminated message display systems and more particularly to such display systems utilizing a multiplicity of color arrays.

Numerous illuminated signs are prevalent today and, in particularly, a shadow or light box with a panel which may be a silhouette of the message to be displayed. Although not used as extensively, gas signs, such as, neon, argon, and so forth continue to be used.

Modern signs are intended to be more aesthetic to the surroundings and thus, many modern signs use a panel that carries the message with fluorescent or other type of illumination behind the panel.

U.S. Pat. No. 1,901,141, issued to Darnell discloses a message conveying apparatus utilizing a frosted glass panel containing a desired message on one surface thereof and a louvered wire screen on the same side which prevents the message from being viewed except upon illumination from within the housing for the apparatus. The typical example is to display a "No Left Turn" message.

U.S. Pat. No. 5,237,766, issued to Mikolay discloses a illuminated sign consisting of a message carrying wall having a front display side and a rear side. The message carrying wall has an opaque portion to block light transmission therethrough from a source on the rear side of the message carrying wall to produce an illuminated message visually detectable and a lenticular structure at the front of the message carrying wall for intercepting the light transmitted from the rear side of the wall through the translucent portion of the message carrying wall defusing the light so as to give the appearance that the light source is at the front of the message carrying wall.

U.S. Pat. No. 4,864,475, issued to Jung discloses a rainbow light box utilizing a plurality of fluorescent lamps covered by colored transparent thin plastic tubing. The fluorescent tubes are closely nested to each other inside a diffusion panel sleeve. The lamps and colored sleeves are held by openings installed on side frame posts. The close proximity of the fluorescent lamps in the diffusion sleeve provide a mixing or blending of colors emanating from the light box which with the proper selection and arrangement of the colored thin wall tubing to display a rainbow array of colors.

Typically the prior art signs continue various drawbacks with respect to attractiveness and with the cost and availability of materials utilized. The present invention overcomes many of the previous drawbacks.

SUMMARY OF THE INVENTION

The present invention provides a freestanding or mountable message display system utilizing fluorescent lamps which include changeable translucent color sleeves to display an array of colored lights, as well as, translucent sleeves with various aesthetic designs or patterns such as checker board, squares, circles, spirals, triangles, stars, stripes, etc. A message box is provided enclosing a portion of the fluorescent lamps with an interchangeable face panel or message card to display various messages. The fluorescent lamps are generally sleeveless in the message box area to provide a brighter message, or depending on the type of sign may display the message in the blended color of the fluorescent lamps. One of the features of the present invention is to provide an open-air display of the fluorescent lamps with the various colors chosen for aesthetics.

Additionally, the message display system may be one sided displaying a single message with a reflector or diffuser extending the length of the fluorescent lamps in the back of the sign to diffuse and reflect the array of colored light from the fluorescent lamps. In this arrangement the message display system can be either free standing, suspended or mounted to a wall or similar structure. The sign base, side frames and top provide an enclosed passageway or conduit for all of the electrical elements to avoid exposure to the weather yet, provides relatively easy maintenance of the fluorescent lamps and the overall display system. The message display box is such that it may have a convex or flat face and suitable for frequent change in messages.

Thus, it will be understood that the message display system provides a colorful array of fluorescent lamps to attract the attention of observers while displaying a practical message or advertisement. The fluorescent lamps may be spaced apart or with little or no spacing between. By including translucent color sleeves each fluorescent lamp may be displayed with several different or the same color sleeves. The translucent sleeve may be any color of the entire light spectrum. Further, the fluorescent lamps may have back reflectors to concentrate the light emitted and back diffuser to mix the colors emanation from the message display system. The double sided message display system may include a double row of fluorescent lamps, and may have reflectors and diffusers placed between the rows of fluorescent lamps.

BRIEF DESCRIPTION OF THE DRAWINGS

FIG. 9 is a top view of a single faced horizontal message display system adapted for suspension from a suitable support;

FIG. 10 is a front view of the single faced horizontal message display system adapted for suspension from a suitable support;

FIG. 11 is a side view of the message display system illustrated in FIG. 10;

FIG. 12 is a perspective view of a double faced message display system suitable for suspension; and FIG. 13 is a perspective view of a double sided flat face message display system supported from a masonry pedestal.

DETAILED DESCRIPTION OF THE INVENTION

Figure 4B:
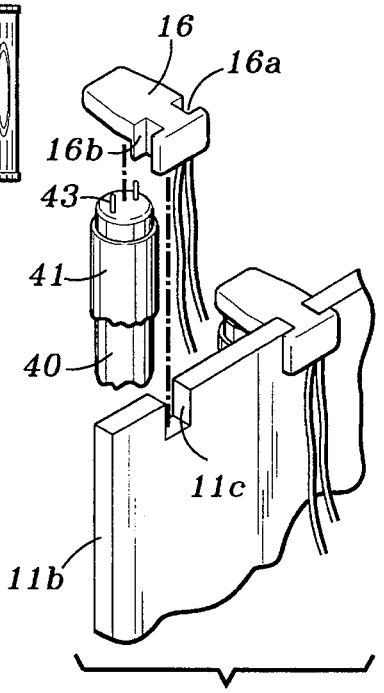
FIG. 4B is an exploded view in perspective of the fluorescent lamp and electrical socket support arrangement.

Referring now to the drawings and in particular to FIGS. 1–4B there is illustrated a free standing message display system 10. Display system 10 has a support or main frame 11 defining a flat hollow body having a pair of spaced apart panels 11*a* and 11*b*. The message display system 10 has a support base 12 which includes a base plate 13, a socket housing 14 and a wedge-shaped compartment 15. Socket housing 14 has a front wall 14*a*, a rear wall 14*b* and a flat base 14*c*. Panel 11*b* of main frame 11, as best seen in FIG. 4B, has a series of slots or notches 11*c* in which are seated a series of lamp sockets 16 and each lamp socket has a pair of slots or notches 16*a* and 16*b*. The lamp sockets 16 are mounted in notches 11*c* of panel 11*b* mated with notches 16*a* and 16*b* thus straddling panel 11*b* and firmly seated in notches 11*c*. The main frame 11 includes the lamp sockets 16, as illustrated in FIG. 4B, at both the top and bottom of panel 11*b* which are mounted in the same manner. The main frame 11 is positioned within socket housing 14 with lamp sockets 16 affixed to the flat base 14*c* of socket housing 14 and panel 11*a* of main frame 11 is in abutment with rear wall 14*b* of socket housing 14 and is secured thereto by any suitable means, such as, nuts and bolts or spot welds and so forth. A wedge-shaped compartment 15 is formed by a pair of triangular side plates 15*a* and 15*b* which are secured to base plate 13 of support base 12, and has a removable cover 15*c*. An electrical switch 15*d* is mounted on cover panel 15*c* and the compartment houses ballast 18 and electrical outlet wire 19. The triangular panels 15*a* and 15*b* are secured to panel 11*b* thus, providing additional support for main frame 11. The lower end of main frame 11 as viewed in FIG. 4 has an opening 17 in communication with wedge-shaped compartment 15.

Figure 1:
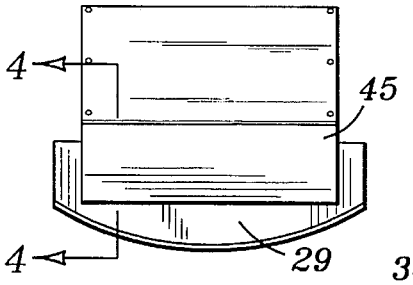
FIG. 1 is a top view of the message display system having a single face.
Figure 4A:
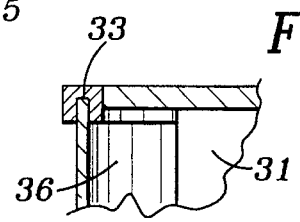
FIG. 4A is an enlarged sectional view along the circle 4 A of FIG. 4.
Figure 2:
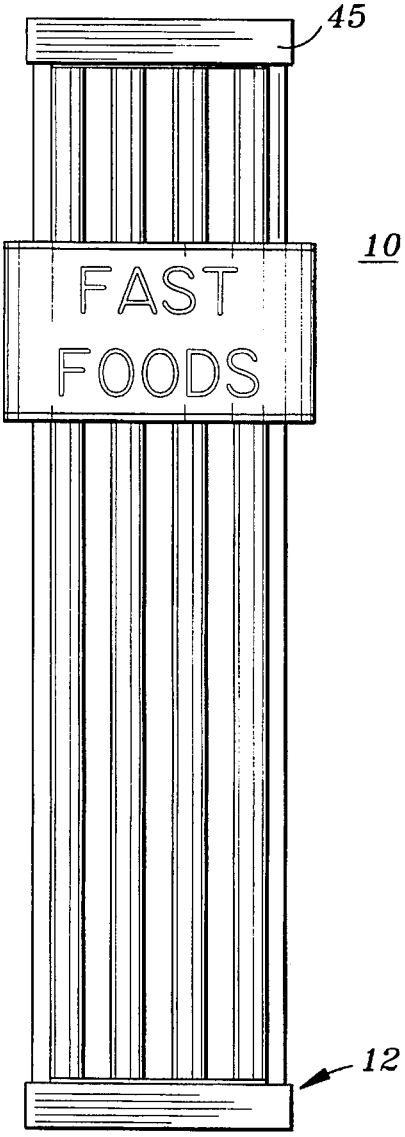
FIG. 2 is a front view of the message display system illustrated in FIG. 1.
Figure 3:
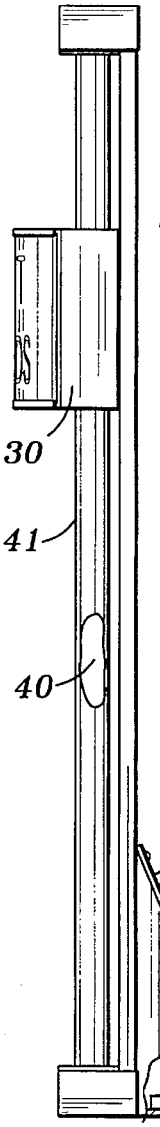
FIG. 3 is a side view, partially cut away of the message display system in FIG. 2 exposing the electrical power unit for the message display.
Figure 4:
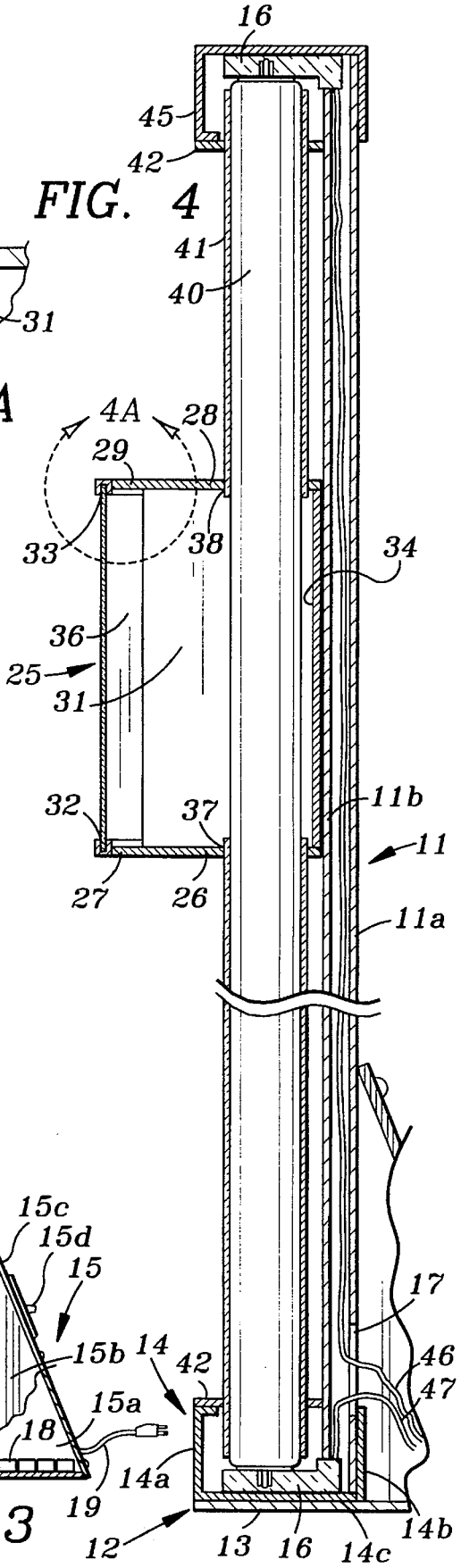
FIG. 4 is a partial cross sectional view taken along the line 4—4 in FIG. 1.

Mounted intermediate the middle and top of main frame 11 is a message display box 25. Message box 25 has a bottom panel 26 with a crescent shape periphery 27, a top panel 28 having a crescent shaped periphery 29, and a pair of side walls 30 and 31. Mounted to the crescent shape periphery 27 of bottom panel 26 and crescent shaped periphery 29 of top panel 28 are channels 32 and 33, respectively. Bottom panel 26 and top panel 28 have a series of apertures 37 and 38, respectively, therethrough, similar to those as viewed in FIG. 6, sufficient in size for the purposes hereinafter described. Message box 25 has a back wall 34 which supports the message box 25 from main frame 11. Channels 32 and 33 in message box 25 are adapted to receive flexible message card or sign 36 which may contain any suitable message, such as, Fast Foods as illustrated in FIG. 2.

A series of fluorescent lamps 40 with translucent sleeves 41 are inserted through apertures in top panel 28 and bottom panel 26, then through apertures in weather shield 42 if required, and seated in lamp sockets 16 in socket housing 14. Weather shield 42 is placed over fluorescent lamps 40, and then the upper lamp sockets 16 are simultaneously seated over the electrical prongs 43 of fluorescent lamp 40 while being fitted into slots 11*c* in panel 11*b* of main frame 11. A cover 45 is seated over the upper series of lamp sockets 16 and secured to panel 11*a* of main frame 11 and weather shield 42 to protect the electrical lamp sockets 16 from the elements and are secured in any suitable means depending on the material, such as, by nuts and bolts or screws or the like. The translucent covers 41 on the fluorescent lamps 40 extend just into the message box 25 such that substantially the entire fluorescent lamps 40 within message box 25 is sleeveless and provides illumination undiminished by translucent covers 41 for the flexible message sign 36. The electrical wiring 46 from upper lamp sockets 16 leads to the ballast 18 in wedge-shaped compartment 15. Likewise, electrical wire 47 leads from lower lamp sockets 16 to ballast 18 in wedge-shaped compartment 15.

Referring now specifically to FIGS. 5, 6, 7 and 8, there is shown a free standing double faced message display system generally referred to as 100. The message display system 100 has a pedestal base 102 and a pair of upright hollow posts 103 and 104 extending upright from pedestal base 102 and are secured therein. Posts 103 and 104 each have three inboard indentions or channels 109. In the central indentions 109 double sided mirror 105 is secured between the posts and extends from the pedestal base 102 into top cover 111. On either side of double sided mirror 105 are diffusion panels 106 and 107 seated in indentions 109. Hollow posts 103 and 104, double sided mirror 105 and diffusion panels 106 and 107 comprise main frame 110. The diffusion panels 106 and 107 each extend from the pedestal base 102 to the top cover 111. The top and bottom edges of diffusion panels 106 and 107 are similar in configuration as the top and bottom of panel 11*b* of the main frame 11 as illustrated in FIG. 4B with slots 11*c* to accommodate lamp sockets 16 with slots 16*a*. Of course, the bottom of diffusion panels 106 and 107 are the mirror images of each other like the top of panel 11c illustrated in FIG. 4B. Fluorescent lamps 140 and translucent sleeves 141 extend from pedestal 102 through message box 125 on both sides of hollow posts 103 and 104 into top cover 111. For brighter illumination, translucent sleeves 141 terminated just inside message box 125.

Referring now to FIGS. 9–13, there is illustrated a single sided 200 and double sided 250 and 300 horizontal message display systems. Referring specifically to FIGS. 9, 10 and 11, message display system 200 is the horizontal counterpart of message display system 10 of FIG. 2 without the wedge-shaped compartment 15. The message display system 200 has a pair of end compartments 202 with main frame 203 extending between the pair of end compartments 202. Message box 205 is supported from main frame 203. Message box 205 is substantially the same construction as message box 25 as viewed in FIGS. 1–4A. It will be observed that message box 205 is centered on main frame 203. The electrical system for energizing message display system 200 is similar to that described in connection with FIGS. 4 and 4B, except the ballast may be placed in the bottom of main frame 203 which is similar to main frame 11 of FIG. 4. Message Display system 200 has hooks or eyelets 207 secured to end compartments 202. Fluorescent lamps 210 extend between end compartments 202 in front of main frame 203 and through message box 205 in similar fashion as described in connection with FIGS. 1–4B. Fluorescent lamps 210 have translucent sleeves 211 extending over at least the portion of fluorescent lamps 210 exposed to view. If necessary, weather shields 208 may be positioned around fluorescent lamps 210, translucent sleeves 211 and secured against end compartments 202.

Figure 5:
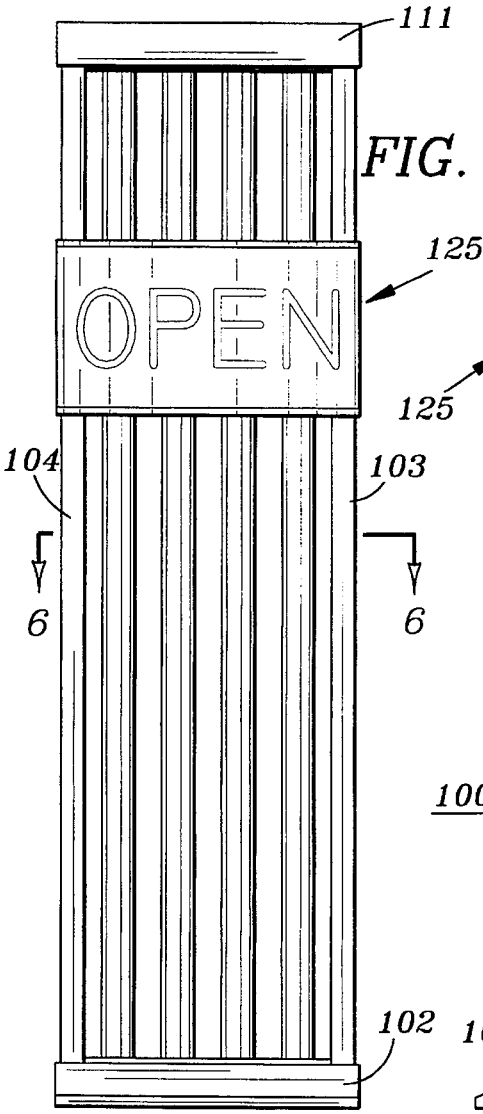
FIG. 5 is a view of one face of the double faced message display system.

Referring now to FIGS. 12 and 13, a double faced message display system 250 is illustrated similar in construction with FIG. 5. Message display system 250 of FIG. 12 and message display system 300 in FIG. 13 are similar to message display system 100 except the message box 305 of message display system 300 has a flat open face and message card rather than a convex open face and message card.

Specifically referring to FIG. 12, message display system 250 includes end compartments 252, a main frame 253 extending between end compartments 252 and has message box 255 mounted on main frame 253. Fluorescent lamps 260 extending between end compartments 252 and through message display box 255 similarly as in FIG. 5 and FIG. 10. Fluorescent lamps 260 have translucent sleeves 261 extending over at least the portion of fluorescent lamps 260 exposed to view. End compartments 252 may be protected with weather shield 258.

Specifically referring to FIG. 13, message display system 300 has a pair of end compartments 302, a main frame 303 extending between end compartments 302. Message display system 300 has a message box 305 supported centrally along main frame 303 with a flat open face and message card. Fluorescent lamps 310 extend between end compartments 302 and through message box 305. Fluorescent lamps 310 have translucent sleeves 311 extending over at least the portion of fluorescent lamps 310 exposed to view. Message display system 300 is illustrated on a masonry base 320 which could be of any height or design which would add to the aesthetics of the message display system 300. The electrical system for energizing the fluorescent lamps 310 with translucent sleeves 311 may be provided in the bottom of main frame 303 or in end compartments 302. End compartments 302 may be protected with weather shield 308.

As described in connection with FIGS. 9–13, main frame 203, main frame 253 and main frame 303 may be the same as main frame 110 described in connection with FIGS. 5–6

Figure 6:
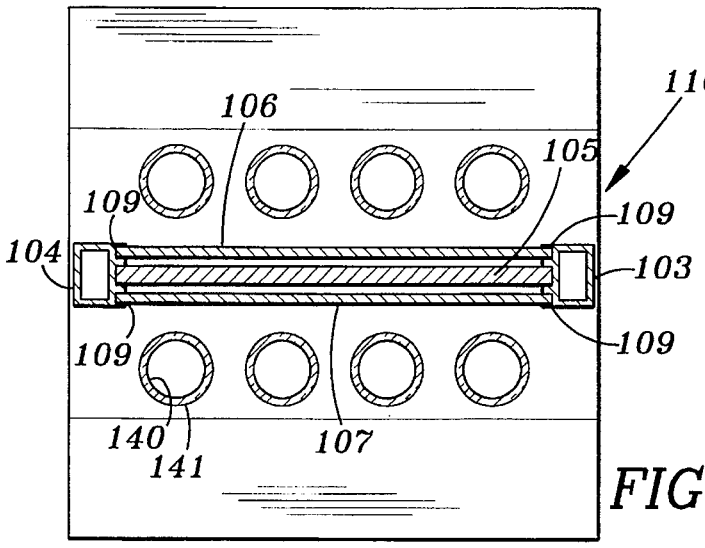
FIG. 6 is an enlarged cross sectional view taken along line 6—6 of FIG. 5 of the double faced message display system.
Figure 8:
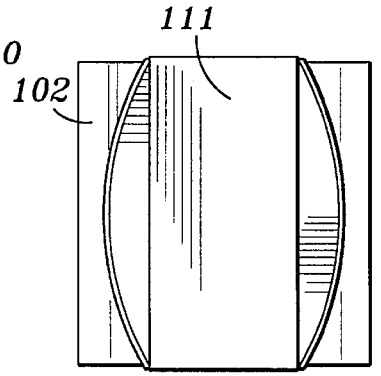
FIG. 8 is an enlarged top view of the double faced message display system of FIG. 7.
Figure 7:
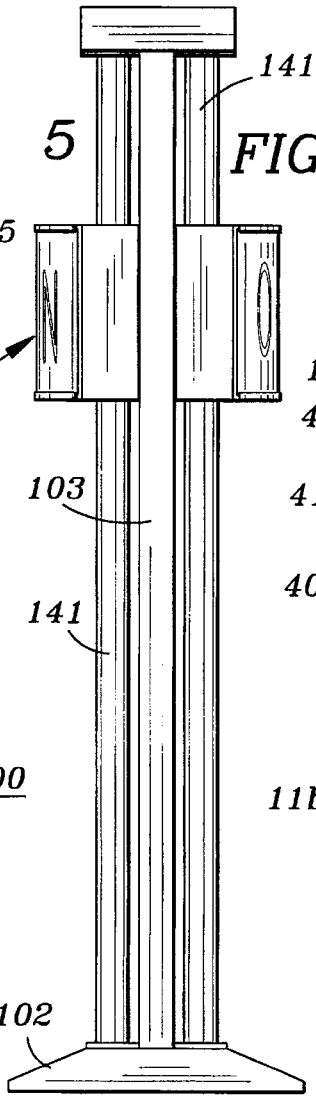
FIG. 7 is a side view of the double faced message display system.

It will also be appreciated, that the horizontal message display systems illustrated in FIGS. 9–13 may be constructed with upper and lower hollow posts and utilize the double faced mirror and diffusion panels as illustrated in FIGS. 5, 6, and 7.

It will be understood that the various designs of the single faced and double faced message display systems may be constructed from plastic or metal as desired and would use appropriate fasteners depending on the choice of materials of construction. It will be understood, that one of the features of the message display system is the aesthetics of fluorescent lamps of multiple colors and design patterns which are attractive to potential customers and clients to provide a lasting impression on the viewer as to the message being conveyed. It will also be understood, that more than one message box may be used in the message display system so long as a substantial portion of the fluorescent lamps are exposed to view without detracting from the aesthetics of the message display system.

What is claimed is:

1. An illuminated message display system comprising:

a) a pedestal housing;

b) a main frame supported by and extending upright from the pedestal housing;

c) a top housing for said main frame;

d) a message box supported from said main frame intermediate the pedestal housing and top housing, said message box having an open face and a back lit message card positioned in said open face;

e) an array of fluorescent lamps for back lighting the message card extending from the pedestal housing outside the main frame through the message box and into the top housing, a portion of each said lamp of said array of fluorescent lamps is exposed to view outside of said message box intermediate the pedestal housing and top cover;

f) translucent sleeves selected from the group consisting of multiple solid colors and aesthetic designs and patterns, said sleeves extending over at least the portion of the fluorescent lamps exposed to view; and g) an electrical system within said pedestal housing, main frame and top housing for energizing the array of fluorescent lamps.

2. The message display system of claim 1 wherein the multiple solid colors for said translucent sleeves are selected from the group consisting of the colors of the entire visible light spectrum.

3. The message display system of claim 1 wherein the designs and patterns are selected from the group consisting of squares, circles, spirals and triangles.

4. The message display system of claim 1 wherein the message box has a convex open face.

5. The message display system of claim 1 wherein the translucent sleeves extend over the entire fluorescent lamps to provide a blended color illumination of the message card.

6. An illuminated message display system comprising:

a) a support frame;

b) a pair of side housings spaced apart for retaining the support frame horizontally therebetween;

c) a message box mounted to and centrally spaced upon the support frame, said message box having at least one open face and one back lit message card positioned in said one open face;

d) an array of fluorescent lamps for back lighting the message card extending between said pair of side housings through said message box outside the support frame, a portion of each said lamps of lamps is said array of fluorescent exposed to view outside of said message box intermediate said pair of side housings;

e) translucent sleeves selected from the group consisting of colors of the light spectrum and aesthetic designs, said sleeves extending over at least the portion of the fluorescent lamps exposed to view; and f) an electrical system within said pair of side housings and said main frame for energizing the array of fluorescent lamps.

7. The message display system of claim 6 wherein the support frame comprises a pair of spaced apart hollow posts extending between the pair of side housings, wherein a wall of one of said posts faces a wall of the other of said posts said pair of spaced apart hollow posts having a first, center, and second parallel indentions in the walls facing each other, a double sided mirror positioned in the center indention and a pair of diffusion panels positioned on either side of the double sided mirror in the first and second indentions; the message box straddles the support frame and has said open face and said back lit message card positioned and exposed to view on opposite sides of the support frame; and the array of fluorescent lamps extend between the side housings through the message box on both sides of the support frame.

8. The message display system of claim 7 wherein the translucent sleeves extend of said lamps on both sides of the support frame and the colors of the translucent sleeves on one side of the support frame are different from the colors of the sleeves on the opposite side of the support frame.

9. The message display system of claim 6 wherein the translucent sleeves extend throughout the message box.

10. The illuminated message display system of claim 6 wherein the aesthetic designs are selected from the group consisting of stars and stripes.

11. A double sided illuminated message display system comprising:

a) a pedestal housing;

b) a pair of spaced apart hollow posts supported by and extending upright from the pedestal housing, said pair of hollow posts each having three vertical indentions facing each other;

c) a top housing for and extending between the pair of hollow posts for maintaining the pair of posts parallel;

d) a double sided mirror and a pair of diffusion panels straddling said mirror supported in the indentions of and extending between the pair of hollow posts;

e) a double faced message box supported by said pair of hollow posts intermediate the pedestal housing and the top housing with the double sided mirror and the pair of diffusion panels extending centrally there through, said message box having a pair of open faces and a back lit message card positioned in each of said pair of open faces;

f) an array of fluorescent lamps for back lighting the message cards extending outboard of each of said pair of diffusion panels from the pedestal housing through the message box and into the top housing, a portion of each said lamps of said array of fluorescent lamps are exposed to view outside of said message box intermediate the pedestal housing and top cover;

g) translucent sleeves selected from the group consisting of multiple colors of the light spectrum and aesthetic designs, said translucent sleeves extending over at least the portion of the fluorescent lamps exposed to view; and h) an electrical system within said pedestal housing, hollow posts and top housing for energizing the array of fluorescent lamps.

12. The double sided illuminated message display system of claim 11 wherein the translucent sleeves extend throughout the message box to provide a blended color illumination of the pair of message cards.

13. The double sided illuminated message display system of claim 11 wherein the aesthetic designs are selected from the group consisting of squares, circles, spirals and triangles.

14. The illuminated message display system of claim 11 wherein the aesthetic designs are selected from the group consisting of stars and stripes.

15. An illuminated message display system comprising:

a) a main frame of rectangular shape with opposed short sides;

b) housings secured to each of said opposed short sides, at least one of said housings providing support for the message display system from a structure;

c) a message box supported from said main frame intermediate the housings, said message box having at least one open face and back lit message card positioned in said at least one open face;

d) an array of fluorescent lamps for back lighting at least one said back lit message card extending between said housings outside the main frame and through the message box, a portion of each said lamp of said array of fluorescent lamps is exposed to view outside of said message box intermediate said housings;

e) translucent sleeves selected from the group consisting of multiple solid colors and aesthetic designs and patterns, said sleeves extending over at least the portion of the fluorescent lamps exposed to view; and f) an electrical system within said housings and said main frame for energizing the array of fluorescent lamps.

* * * * *